US010076148B2

(12) United States Patent
Belle, Jr.

(10) Patent No.: US 10,076,148 B2
(45) Date of Patent: Sep. 18, 2018

(54) BESPOKE CAP HAVING TWO DISTINCT FABRIC PATTERNS

(71) Applicant: Compton Alvin Belle, Jr., Elmsford, NY (US)

(72) Inventor: Compton Alvin Belle, Jr., Elmsford, NY (US)

( * ) Notice: Subject to any disclaimer, the term of this patent is extended or adjusted under 35 U.S.C. 154(b) by 260 days.

(21) Appl. No.: 15/181,342

(22) Filed: Jun. 13, 2016

(65) Prior Publication Data

US 2016/0324244 A1 Nov. 10, 2016

Related U.S. Application Data

(63) Continuation-in-part of application No. 13/815,263, filed on Feb. 14, 2013, now abandoned.

(51) Int. Cl.
*A42B 1/22* (2006.01)
*A42B 1/06* (2006.01)

(52) U.S. Cl.
CPC ..... *A42B 1/225* (2013.01); *A42B 1/061* (2013.01)

(58) Field of Classification Search
CPC ..... A42B 1/225; A42B 1/061; A42B 1/004; A42B 1/02
USPC ..... 2/195.1
See application file for complete search history.

(56) References Cited

U.S. PATENT DOCUMENTS 5,509,144 A * 4/1996 Soergel ..... A42B 1/248 2/195.1
5,647,064 A * 7/1997 Whittaker ..... A42B 1/002 2/175.4
5,715,540 A 2/1998 Cho
5,771,493 A * 6/1998 Proctor ..... A42B 1/004 2/171.1
5,781,933 A * 7/1998 De Giacomi ..... A61F 9/045 2/195.1
5,799,334 A 9/1998 Griffith et al.
5,875,494 A 3/1999 Garnie et al.
5,926,850 A 7/1999 Han
5,992,027 A 11/1999 Mack
D424,282 S 5/2000 Crumpton
6,560,785 B1 * 5/2003 Taguchi ..... A42B 1/206 2/10
6,675,393 B1 * 1/2004 Park ..... A42B 1/062 2/12
D517,781 S 3/2006 Ortley et al.
D618,446 S * 6/2010 Clare ..... D2/878
7,814,573 B1 10/2010 Greenburg
(Continued)

*Primary Examiner* — Alissa L Hoey
(74) *Attorney, Agent, or Firm* — Benjamin Davis

(57) ABSTRACT

The present invention generally relates to a bespoke cap for covering and gathering dreadlocks. More specifically, two distinct fabric patterns are layered to form a cap. The first layer's fabric pattern is a crown having a front facing brim and a half oval cut into its rear surface. The crown provides a deep volume to accommodate a large amount of dreadlocks. The second layer is a five piece fabric pattern that is sewn onto and over the first layer. Both layers combine to provide an adjustable oval like aperture at the back of the cap, which allow dreadlocks to be covered and gathered naturally without being damaged. Top panels associated with the second layer have rear closing straps that cinch the aperture at an angle. Each top panel stretches and folds over the first layer's front facing brim to its underside, providing a stylish flat-cap appearance.

7 Claims, 12 Drawing Sheets

(56) References Cited

U.S. PATENT DOCUMENTS

| | | | | |
|---|---|---|---|---|
| D632,875 | S | 2/2011 | Bischel | |
| 8,640,264 | B2 * | 2/2014 | Ramer | A42B 1/062 2/171.3 |
| D796,158 | S * | 9/2017 | Belle Jr. | D2/865 |
| 2005/0246825 | A1 * | 11/2005 | Ruhl | A42B 1/18 2/422 |
| 2006/0112475 | A1 * | 6/2006 | Wang | A42B 1/02 2/195.5 |
| 2006/0185060 | A1 * | 8/2006 | Bang | A42B 1/069 2/195.1 |
| 2006/0206984 | A1 * | 9/2006 | Jaye | A42B 1/225 2/209.3 |
| 2007/0143906 | A1 * | 6/2007 | Renteria | A42B 1/064 2/195.1 |
| 2008/0034475 | A1 | 2/2008 | Boord | |
| 2009/0241239 | A1 * | 10/2009 | Reynolds | A42B 1/206 2/172 |
| 2010/0107308 | A1 * | 5/2010 | Hosie | A42B 1/064 2/209.12 |
| 2010/0192282 | A1 * | 8/2010 | Matthews | A42B 1/041 2/174 |
| 2011/0302697 | A1 * | 12/2011 | Jaquez | A42B 1/206 2/209.12 |
| 2014/0223637 | A1 * | 8/2014 | Belle, Jr. | A42B 1/061 2/195.1 |

* cited by examiner

BESPOKE CAP HAVING TWO DISTINCT FABRIC PATTERNS

RELATED APPLICATIONS

This non-provisional patent application is a continuation-in-part of and claims priority to U.S. patent application Ser. No. 13/815,263 filed on Feb. 14, 2013.

FIELD OF THE INVENTION

The present invention generally relates to a bespoke cap for covering and gathering dreadlocks. More specifically, two distinct fabric patterns are layered to form a cap. The first layer's fabric pattern is a crown having a front facing brim and a half oval cut into its rear surface. The crown provides a deep volume to accommodate a large amount of dreadlocks. The second layer is a five piece fabric pattern that is sewn onto and over the first layer. Both layers combine to provide an adjustable oval like aperture at the back of the cap, which allow dreadlocks to be covered and gathered naturally without being damaged. Top panels associated with the second layer have rear closing straps that cinch the aperture at an angle. Each top panel stretches and folds over the first layer's front facing brim to its underside, providing a stylish flat-cap appearance.

BACKGROUND OF THE INVENTION

Dreadlocks, hereinafter locks, are a hairstyle common for afro-textured hair, but others with finer hair may also wear the hairstyle. Locks are matted coils of hair. To matt hair for locks, one stops brushing, combing, or cutting their hair and twist their hair into separate small sections. The more sections one creates the more locks will form. Once a lock is formed, new hair will continue to grow into a tangled pattern. Up close each lock looks like steel wool. The hairs are tangled and woven together so thoroughly that they form one solid mass. As hair continue to grow, locks become more and more interwoven until permanent.

Because locks vary greatly in size, width, shape, length, and texture, people with long locks have a hard time finding nice fashionable caps that fit comfortably and cover the entire head without damaging the hair. Thick long locks substantially increase the volume about the wearer's head when gathered into a ponytail or worn freely at ear or neck length.

Common caps for locks include, but are not limited to, large crochet tams, beanies, wool knitted tams, and large adjustable baseball caps with rear apertures and a closing. These caps are informal looking and not very chic when wearing a nice suit of clothing. Also, for people with long thick locks, baseball caps and fine caps, such as newsboy and ivy caps, derbies, and such, are ill fitting, uncomfortable, and do not cover the entire head of locks.

People often resort to cutting holes in baseball caps to make headroom for their locks. They use cap stretchers to increase the circumference of the cap band. The most widely known size adjuster for casual caps is a pair of plastic straps. Casual caps use snaps located at the ends of a semicircular aperture forming a gap at the back. The straps are attached at opposite ends of the gap. A first strap has a plurality of holes, and a second strap has a plurality of snaps designed to engage the holes of the first strap. The cap with the snap closings typically accommodates cap sizes from about 6½" to about 8".

Another type of adjustment is a Velcro hook and loop fastener. A first strap having a patch of Velcro loop fasteners is attached to one end of the gap, and a second strap having a patch of corresponding Velcro hook fasteners is attached to the opposite end of the gap.

Caps having either the Velcro hook and loop or the snap closing have similar disadvantages for long dreadlocks. These caps do not preserve a person's locks by limiting pressure at friction points that cut and damage locks. The lining materials for these caps are abrasive and are bad for maintaining healthy locks. The apertures for these caps do not naturally gather locks to reduce pulling and cutting of matted hair.

U.S. Pat. No. 5,926,850 to Han concerns an improved fit cap having an elastic sweat band to fit wearers within a predetermined range of cap sizes.

U.S. Pat. No. 5,715,540 to Cho concerns a free-size cap fitting a range of head sizes.

U.S. Pat. No. D632875 to Bischel concerns a pony tail gathering ball cap. This cap is made of traditional fabrics used to make balls caps that pull, tug, and damage afro-textured dreadlocks.

U.S. Pat. No. 5,875,494 to Garnire and Bradley concerns headwear with a closeable hair opening.

U.S. Pat. No. 7,814,573 to Greenburg concerns a self-sizing ball cap with diverse head band segments.

U.S. Pat. No. D517,781 to Ortley and Kuhtz concerns a cap.

U.S. Pat. No. D424,282 to Crumpton et. al. concerns a cap to accommodate a ponytail.

U.S. Pat. No. 5,799,334 to Griffith and Griffith concerns a baseball cap for pigtail hair styles.

U.S. Pat. No. 5,992,027 to Mack concerns a method of selecting a commercial clothing pattern that discloses the shape and use of a basic bodice block.

U.S. Patent Pub. No. 2008/0034475 to Boord concerns a baseball cap and cover.

The listed references do not provide a cap for people with afro-textured dreadlocks needing a fine cap, where the cap covers the entire head and gathers long locks without damaging them. Therefore, there is a need for a bespoke cap having two distinct fabric patterns layered to cover an entire head of dreadlocks, closing straps associated with top panels from a second layer, and an adjustable rear aperture cinched at a unique angle to gather the dreadlocks to lie naturally when worn.

SUMMARY OF THE INVENTION

Embodiments of the present invention disclose a bespoke cap with a first and a second layer made from two distinct fabric patterns. The first layer comprises a plurality of stitched gore sections forming a crown with a front portion and a back portion, a crescent shaped brim attached to the gore sections along the front portion of the crown, and a rear half oval aperture formed in the gore sections at the back portion of the crown. The second layer comprises a left piece, a right piece, two top panels each having a rear curvature and a crescent shaped brim cover, wherein the two top panels are attached together along a first side edge, are attached to the left piece or the right piece along an opposite second side edge, are attached to the crescent shape brim cover at a first end and comprise a closing strap at a second end. And, wherein the left piece, the right piece and the two top panels are stitched to and on top of the gore sections of the first layer, the crescent shaped brim cover is stitched to and on top of the crescent shaped brim of the first layer, wherein the rear curvature of the two top panels of second layer are stitched to and in alignment with the rear half oval aperture formed in the gore sections of the first layer, thereby forming a bespoke cap with an adjustable rear half oval opening.

It is an aspect of the present invention where each gore section has a reuleaux triangle shape and is made from, single ply buckram, buckram mesh, double buckram mesh, satin, cotton, wool, a rayon/cotton blend, polyester or any combinations thereof.

It is an aspect of the present invention for the bespoke cap to have the rear closing strap of the two top panels having an adjustable closure selected from the group consisting of clasps, buckles and grommets, snaps, hooks and loops, or any combinations thereof.

It is an aspect of the present invention for the inner periphery of the bespoke cap to have a cap band attached to and continues circumferentially around and inside lower peripheral edge of the crown.

It is an aspect of the present invention for the cap band to be made from leather, satin, cotton, wool, a rayon/cotton blend, polyester or any combinations thereof.

It is an aspect of the present invention wherein the stitched gore sections comprise a layer of buckram mesh and another layer of a material selected from the group consisting of silk, satin, cotton, wool, rayon/cotton blend, polyester, or any combinations thereof.

It is an aspect of the present invention for a first end of each top panel to fold over and be stitched to an underside of the crescent shaped brim.

DETAILED DESCRIPTION OF THE INVENTION

Figure 1B:
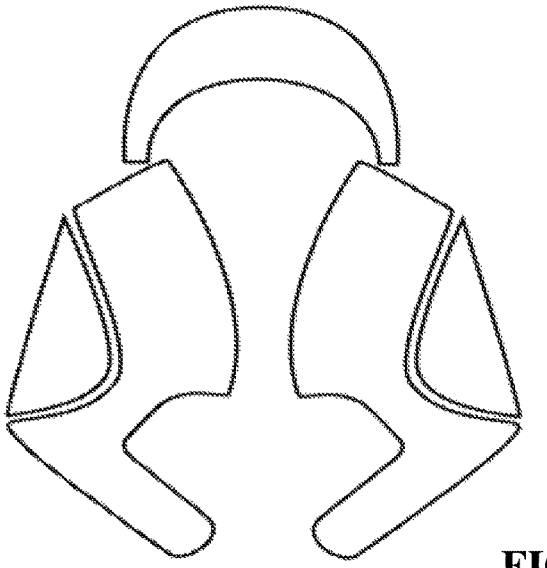
FIG. 1*b* shows the second layer being a five piece fabric pattern, which includes left and right side parts, left and right top panels, and a brim cover.

From this point forward, the following words will describe a bespoke cap for dreadlocks. These words are not a limitation on the scope of the present invention but are written to detail certain embodiments thereof. After reading the detailed description, modifications will become apparent to those skilled in the art and any changes, as such, are intended to be encompassed by this disclosure.

Definitions

The following non-limiting terms are used to detail the invention.

The term "first layer" generally refers to a distinct fabric pattern being a crown formed from stitched gore sections. A fully formed crown has an apex that extends downward to a lower peripheral edge that continues circumferentially around the same, giving the crown an equestrian helmet shape. The first layer, being the crown, also has a front facing crescent shaped brim and, on the back side of the crown, a half oval cut into, at most, three gore sections.

The term "gore section(s)" or "section(s)" generally refer(s) to fabric panels that are shaped like Reuleaux triangles, which are sewn together to form a crown being a first layer for the cap. Each gore section is made from a stiff cloth including but not limited to wool, rayon/cotton blend, cotton or linen, buckram mesh, baby buckram, single ply buckram or double buckram, where all are available in various weights.

The term "apex" generally refers to the highest point at the top of a fully formed crown.

The term "Reuleaux triangle" generally refers to the shape of a single gore section being defined by a constant width curve based on an equilateral triangle, where all points on a side are equidistant from the opposite vertex.

The term "second layer" generally refers to a distinct five piece fabric pattern that forms an outer finish for the first layer of the cap, giving the crown a flat-cap appearance. The fabric pattern includes two top panels, two side parts, and a covering for the underside of the first layer's crescent shaped brim.

The term "top panel(s)" generally refer(s) to two irregular shaped fabric pieces included in the second layer of the cap that provide cover to the crown and rear closing straps. Both top panels are adapted from a template known in the art of fashion as a basic bodice block. A bodice template is typically used for outlining the upper portion of a blouse without the sleeves, a corset, or a vest. For the present invention, the template for a top panel modifies a basic bodice block by cutting a rear curve that extends down to closing straps and mimics the half oval cut into the rear surfaces of the crown when each top panel is sewn over the first layer. Each top panel includes enough fabric to stretch and fold over to the underside of the brim, where the panels and the underside of the brim are stitched together giving the construct a flat-cap appearance.

The term "side parts" generally refer to two tear drop shaped parts that cover the sides of the first layer's crown. Each side part extends downward to the lower peripheral edge of the crown.

The terms "rear aperture," "oval aperture," or "aperture" generally refer to an adjustable oval like hole at the back of the cap that is a combination of a half oval cut into the rear surface of the first layer's crown plus the curved back portions of each top panel that leads to closing straps of the second layer when the top panels are sewn over the crown.

The term "buckram mesh" generally refers to coarse linen or other cotton cloths stiffened with gum or paste and used typically to harden or act as a support for garments, hats, handbags, corsets, baseball caps, and other fashionable fabrics.

Two Fabric Patterns to Make One Cap

Figure 1A:
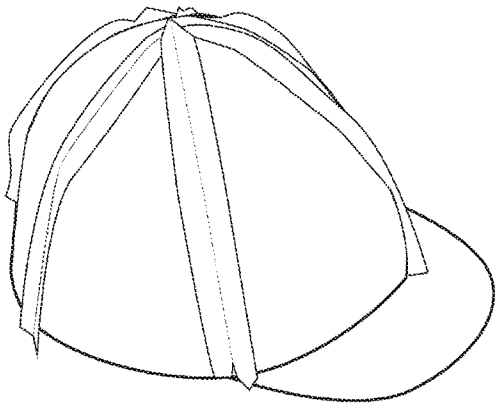
FIG. 1*a* shows the first layer being a fabric pattern for an uncovered crown having an equestrian helmet like shape.
Figure 1C:
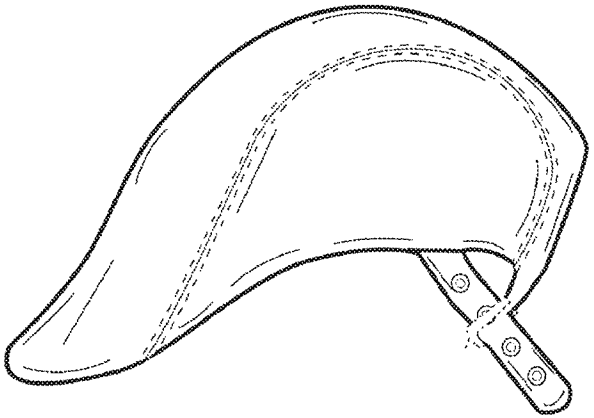
FIG. 1*c* shows a profile of the finished bespoke cap, where the second layer is sewn over the crown of the first layer, which gives the appearance of a stylish flat-cap.
Figure 2:
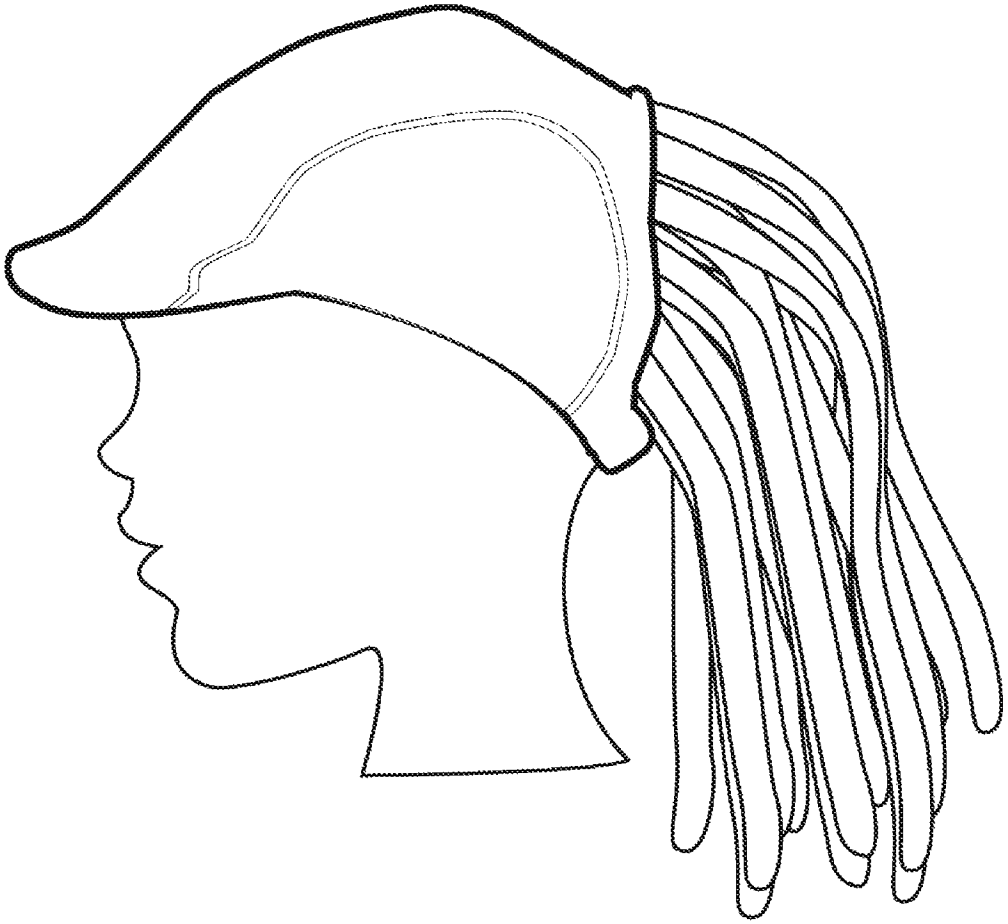
FIG. 2 shows the bespoke cap on a silhouette having dreadlocks collected naturally and gathered by an adjustable rear aperture and straps.

The present invention generally relates to a bespoke cap for dreadlocks made by layering two distinct fabric patterns. From FIG. 1*a*, the first layer includes a fabric pattern for a crown sewn with five to six gore sections made from a fusible fabric, a half oval cut into its rear surface, see FIG. 3*b*, and a front facing brim. Because the fabric pattern for the first layer has an equestrian helmet shape, a greater head room is created by the crown for wearers of dreadlocks. From FIG. 1*b*, the second layer is a five piece fabric pattern. When the first layer is covered and sewn to the second layer, the two distinct fabric patterns form a stylish flat-cap that is capable of holding a large volume of hair, FIG. 1*c*. FIG. 2 shows the bespoke cap on a silhouette having dreadlocks naturally gathered by an adjustable rear aperture.

Figure 3B:
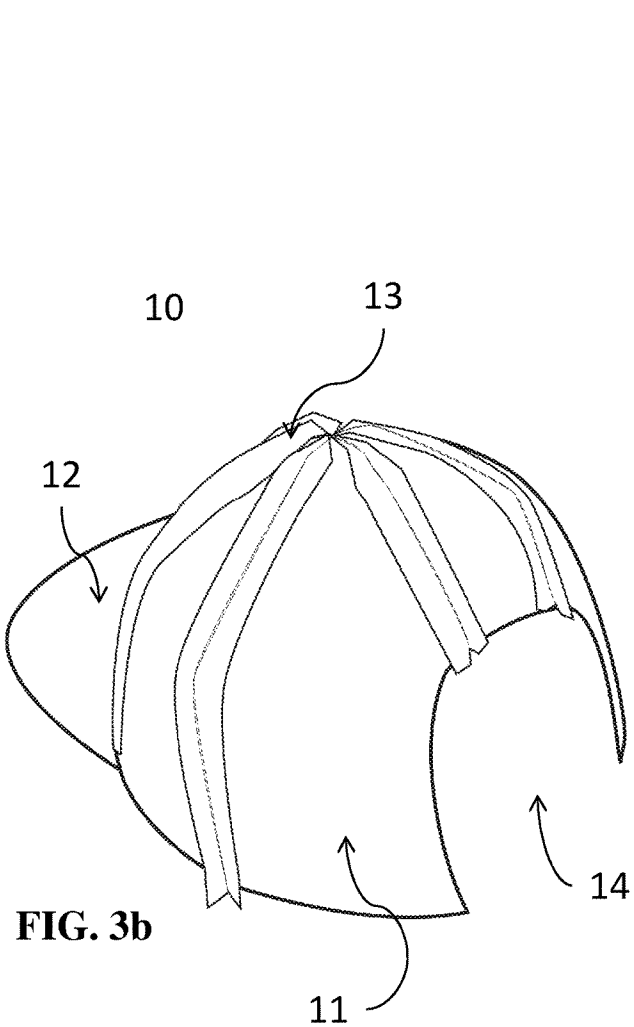
FIG. 3*b* shows a rear view of the first layer's uncovered crown having a rear hole, where the hole is a half oval shape centered at the back of the crown and is cut before being covered by the five piece fabric pattern.
Figure 3A:
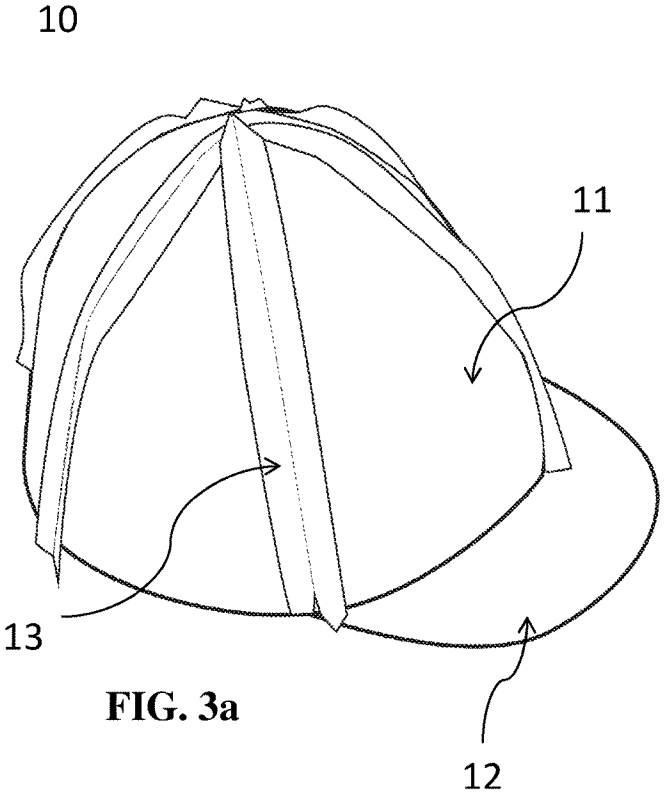
FIG. 3*a* shows the first layer being a fabric pattern for an uncovered crown having an equestrian helmet like shape.

FIG. 3*a* reemphasizes the first fabric pattern as a crown being made from a number of gore sections and having an equestrian helmet like shape. FIG. 3*b* shows the rear surface of the crown having a half oval shape cut into the same, which is a component for forming an adjustable aperture at the rear of the cap with the top panels of the second layer.

Figure 5:
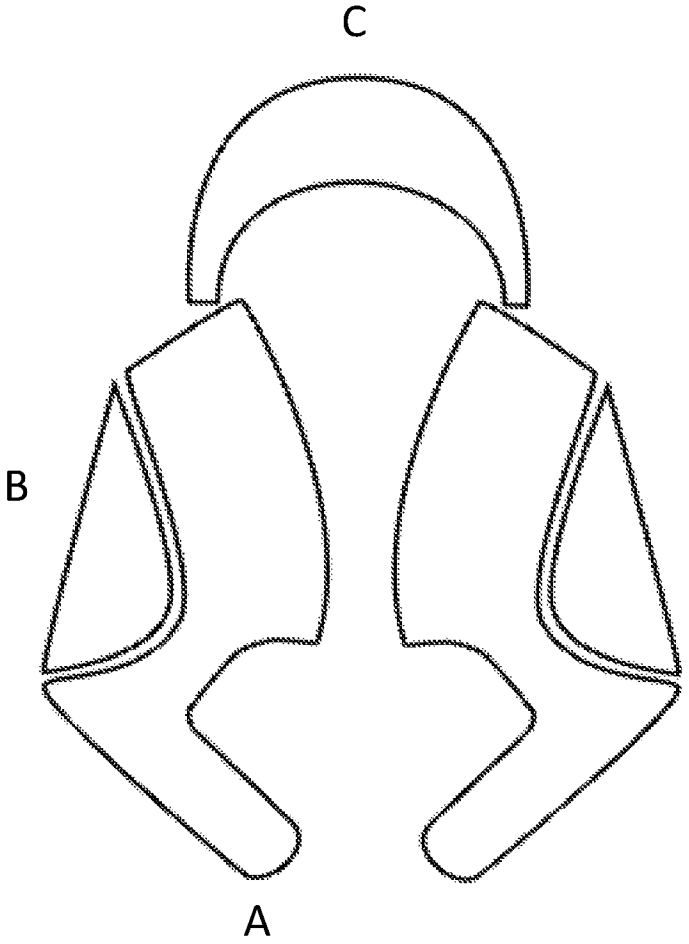
FIG. 5 shows the second layer being a five piece fabric pattern, which includes left and right side parts, left and right top panels, and a crescent shaped brim cover.

FIG. 5 reemphasizes the second layer's five piece fabric pattern. The second layer's fabric pattern includes left and right side parts A, left and right top panels that are templates adapted from basic bodice blocks B, and a brim covering C. The closing straps are only connected to the top panels of the second layer and rest at the nape of the wearer's neck just behind the ears, where the straps cinch the adjustable aperture at a 25° angle relative to the crown's apex.

Raw Materials

The present invention includes layering two distinct fabric patterns constructed from various fabrics and shapes to make a bespoke cap. FIG. 4*a* depicts a single gore section used to form the first layer's fabric pattern, a crown having an equestrian helmet shape. A gore section generally has a Reuleaux triangle shape and may be cut, without limitations, from wool, cotton, rayon/cotton blend, polyester, leather, buckram mesh, baby buckram, single ply buckram, double buckram, or any combinations thereof. FIG. 4*a* line-segment A measures 6" from the top middle to the center of the convex side of the gore. FIG. 4*a* line-segment B measures 4¼" from left edge to right edge. It is within the scope of the present invention where gore sections may also have non-Reuleaux triangle shapes including but not limited to an equilateral triangle shape, a square shape, a mostly circular shape, a shape similar to the architectural template for a cathedral window, a leaf petal shape, or any combinations thereof, which any may be used to stitch together the crown. When cut each gore section is given a fabric allowance from about a ¼" to about 1½".

Also note that, one side of the gore section is lined by a fabric that is sized and cut to have a similar Reuleaux triangle shape as each gore section, including the needed fabric allowance. Fabrics for the liner may include without limitation silk, satin, wool, cashmere, a rayon/cotton blend, polyester, leather, or any combinations thereof.

However, another embodiment includes a gore section being cut from cotton, where the inner panel surfaces are reinforced with buckram mesh of a similar size and shape. In this embodiment, each gore section is stiffened by either gluing or sewing buckram mesh to one of the cotton surfaces. This hybrid cotton/buckram mesh section, when sewn to other similarly treated gore sections, gives a more rigid crown.

It is a preferred embodiment of the present invention where each gore section is made entirely of double buckram mesh, and six gore sections are sewn together to make a crown. Each gore section made entirely of buckram mesh has one of its surfaces lined with a fabric that is cut and sized to match its Reuleaux triangle shape. The liner fabrics may include without limitation silk, satin, wool, cashmere, rayon/cotton blend, polyester, leather, or any combinations thereof. Having lined inner surfaces ensures that the rigid double buckram mesh does not come into contact with the wearer's hair and damage their locks.

There is an inner cap band that is attached to and continues circumferentially about the inside lower peripheral edge of the crown. The cap band is a strip of fabric that measures from about 10" to about 29", where the fabric may include without limitation cotton, rayon/cotton blend, polyester, a thin strip of leather, silk, satin, or any combinations thereof.

Figure 4B:
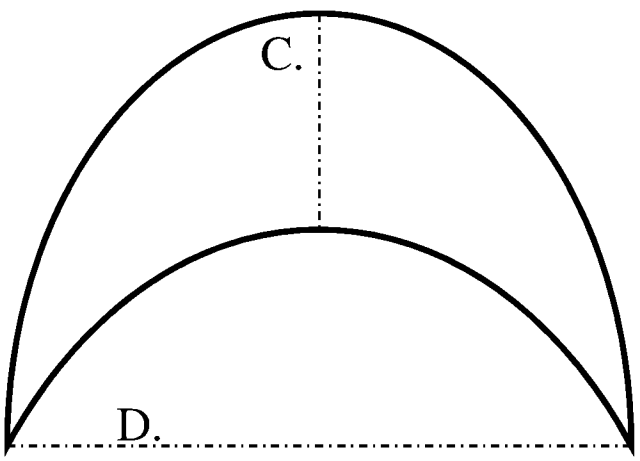
FIG. 4*b* shows the first layer's crescent shaped brim with line-segments.
Figure 4A:
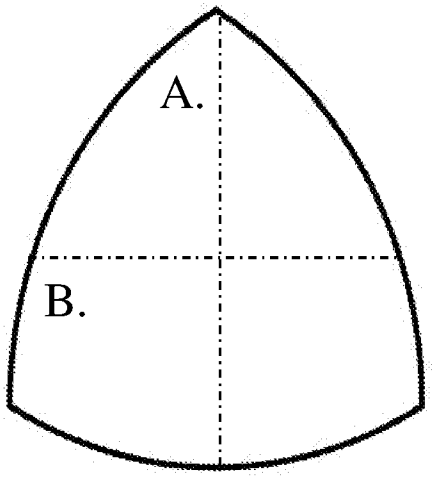
FIG. 4*a* shows a Reuleaux triangle shaped gore section with line-segments used to make the first layer's crown.

FIG. 4*b* depicts the brim being a crescent shape and may be made from a stiffening material, which may preferably be a plastic insert or cardboard covered by a bonded leather material or solely made of double bonded leather.

FIG. 5 depicts a second fabric pattern for the cap as a five piece structure cut from a soft fabric including but not limited to cotton, silk, satin, wool, cashmere, a rayon/cotton blend, polyester, or any combinations thereof. The five piece fabric pattern includes two top panels, two side parts, and a covering for the underside of the first layer's crescent shaped brim. When cut, each pattern piece is given a fabric allowance from about a ¼" to about 1½".

First Layer—Fabric Pattern for Crown and Brim

From FIG. 3*a*, the cap's first layer is a fabric pattern yielding a crown 10 with an equestrian helmet shape and a front facing brim 12. FIG. 3*b* shows a rear view of the uncovered crown 10 and brim 12 having a half oval 14 cut across at most three gore sections 11. A crown 10 is sewn together to have a fabric allowance 13 for each gore section 11. The importance of each gore section 11 was described in the Raw Materials portion of the disclosure.

Staying with FIG. 3*a* and FIG. 3*b*, The crown 10 is formed by overlaying two gore sections 11 right edge to right edge with the liner sides facing inward and the buckram mesh sides facing outward. Sew the two sections 11 together at the overlaid right side. Open the two pieces, overlay a third gore section edge to the right edge for one of the two sewn pieces, where the liner sides are facing inward and the buckram sides are facing outward and sew. Repeat with the three remaining gore sections 11 until the basic shape of the crown 10 is formed. The outside of the crown 10 should show the buckram mesh, and the inside of the crown 10 should be the smooth lining that will have direct contact with the dreadlocks when the cap is worn.

A thin strip of fabric, a cap band, is circumferentially attached to the inside of the crown's 10 lined surface at the lower peripheral edge that extends around the same. The circumference of the crown 10 and cap band may be from about 10" to about 29". This disparate circumference range includes using smaller dimensioned gore sections 11 to make the crown for various sized heads. A complete six section 11 crown 10 will include two generally front facing gore sections 11, two generally back facing gore sections 11, and two generally side facing gore sections 11. The crown 10 can be made with five gore sections 11 as shown, but six gore sections 11 are preferred and give the best results.

A crescent shaped brim 12 is attached to the uncovered crown 10. The brim 12 is sewn onto the front edge of the lower periphery of the uncovered crown 10. However, any suitable manner of joining or connecting the brim 12 will be fine. The crescent shaped brim 12 is made from double bonded leather.

The dimensions of the brim 12 are given by FIG. 4*b*, where line-segment C measures 2¼" from the top center arc of the brim to the lower center arc of the brim. FIG. 4*b* line-segment D measures 6½" from left edge to right edge. Returning for FIG. 3*a* and FIG. 3*b* the brim 12 is front facing and defines the front of the crown 10.

Second Layer—Fabric Pattern for Outer Finish and Closing Straps

FIG. 5 depicts the second layer's five piece fabric pattern that includes left and right side parts A, left and right top panels that are templates adapted from basic bodice blocks B, and a brim covering C. When sewn over the first layer, the second layer's top panels provide closing straps and shape the outer portion of the crown giving the bespoke cap a sleeker newsboy, flat-cap, or ivy cap look.

Figure 6:
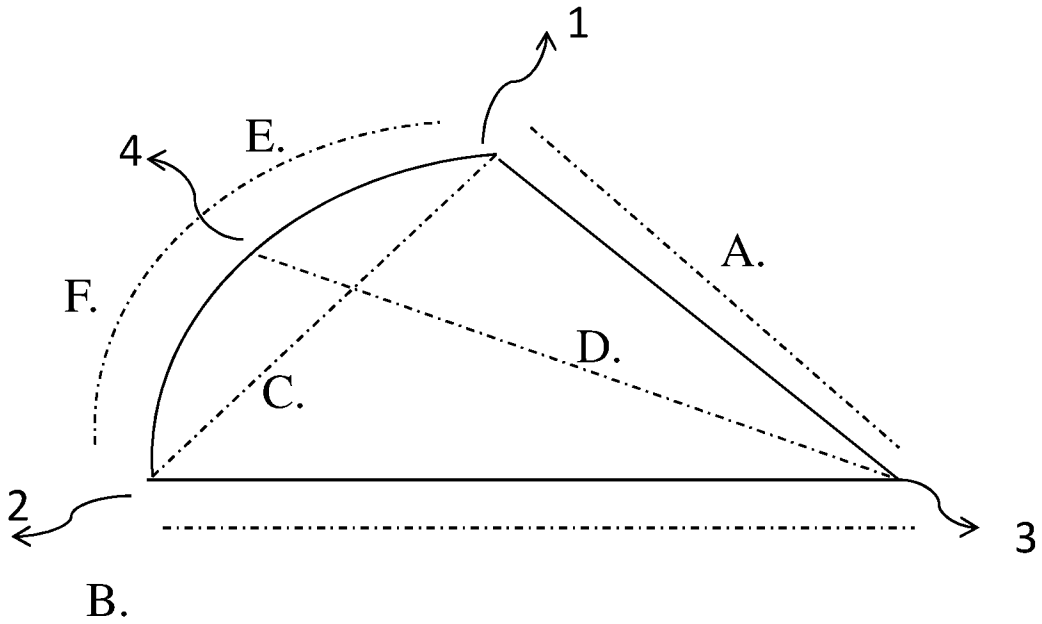
FIG. 6 shows a side part from the second layer's five piece fabric pattern with line-segments

FIG. 6 shows a template for a side part with line segments. Line-segment A measures 6" from the top edge to the right edge 1 of the convex side. Line-segment B measures 6½" from the bottom edge to the bottom edge 2 of the convex side. Line-segment C measures 5" from the bottom edge 2 of the convex side to the top edge 1 of the convex side. Line-segment D measures 8" from the center angle 3 of the side part to the center 4 of the convex edge. Line-segments E and F together measure 5" from the bottom edge 2 of the convex side to the top edge 1 of the convex side. It is an aspect of the invention where the left and right side parts are sewn to the sides of the crown, where their convex edge is similar to that of a French curve. In one embodiment the side parts may extend down from the crown and act as ear flaps.

Returning to FIG. 5, the brim covering C is a piece of cut fabric that is crescent shape and similar to the measurements for line-segments of FIG. 4*b*, being the brim of the first layer, with a fabric allowance from about ¼" to about 1½". The brim covering C is stitched to the underside of the brim to serve as a connecting surface for the front portion of the top panels that are stretched and folded over to the same, where the stretched and folded portions of the top panels are sewn to the underside of the brim to give the final construct a flat-cap appearance.

Second Layer—Top Panels

Figure 7B:
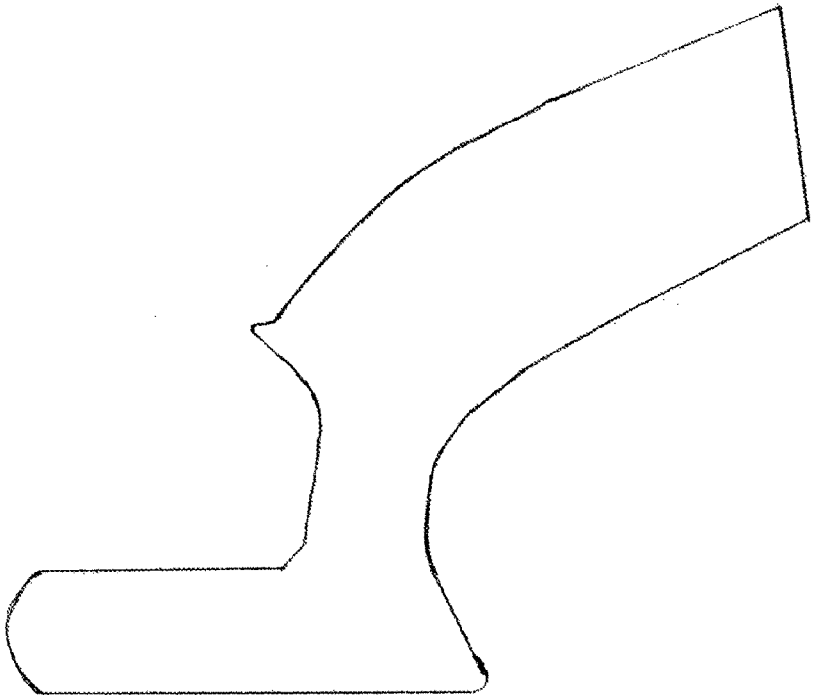
FIG. 7*b* shows a template for a top panel from the second layer's five piece fabric pattern.
Figure 7A:
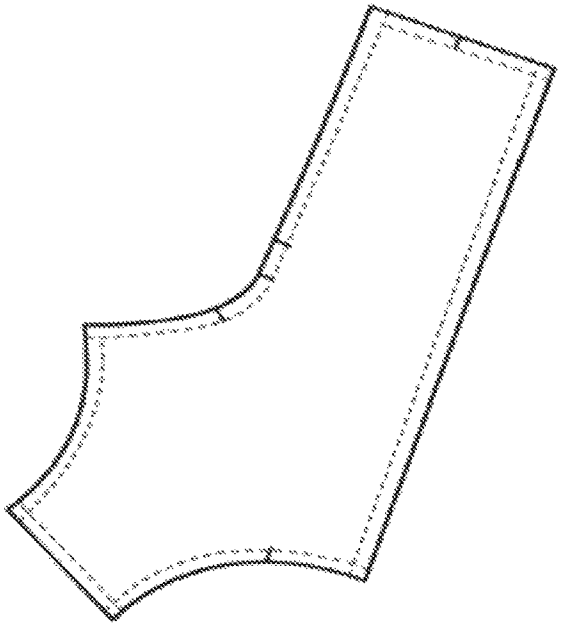
FIG. 7*a* shows a prior art template for a basic bodice block.
Figure 8:
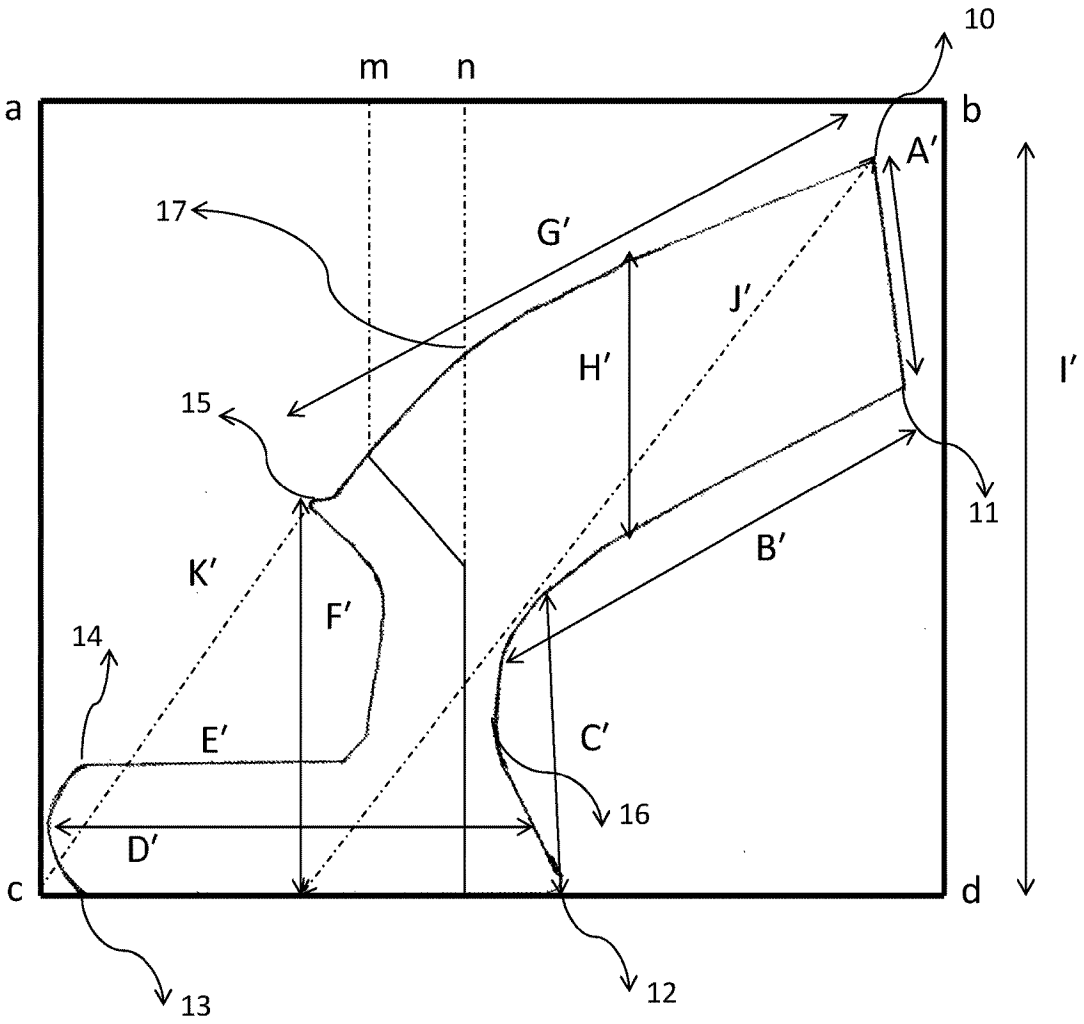
FIG. 8 shows the template for a top panel as a modified bodice in a pattern making grid.

From FIG. 5, the top panels A are a part of the second layer's fabric pattern and are outlined using a modified template commonly associated with creating a basic bodice block, where bodices are irregular shaped garment pieces manufactured to be the upper portions of a blouse without sleeves, a corset, a vest, the front and back portion of trousers, and the like. FIG. 7*a* depicts a prior art bodice block being a template for either a vest or a sleeveless shirt. One aspect of prior art bodices is that they are defined in pattern making grids by irregular curves and angles that outline garment sections that require a significant amount of contouring to cover a human torso, and, typically, each basic bodice block is custom made for whatever garment is being manufactured. As a comparison, FIG. 7*b* depicts the template for creating a top panel for the second layer's five piece fabric pattern of the present invention. FIG. 8 shows the template for a top panel for the present invention in a pattern making grid, abed. This template modifies basic bodice blocks by shaping a rear curve into the body of the top panel that extends down to a closing strap, where the curve mimics a portion of the half oval cut into the rear surfaces of the crown when each top panel is sewn over the first layer.

From FIG. 8, the template for the top panel is defined by the following non-limiting line segments. The front of the top panel is defined by line-segment A and measures 4½" inches from the front edge 10 to the bottom edge 11 of the top panel. The part of the top panel that will be sewn to the side part is defined by the line-segment B, which measures 7" from the bottom edge 11 of the top panel to the center of the French curve 16 used to cut the convex portion of the side part, and line segment C, which measures 5" from the bottom of the panel that starts to gently curve 16 to the back edge 12 of the closing strap. The bottom length of the closing strap is defined by line-segment D and measures 6" from the back edge 12 of the closing strap to the bottom edge of the round tip 13 for the closing strap. The trace between the top edge of the round tip 14 for the closing strap and the top edge 15 for the back of the panel includes half of the construction and orifice for the rear aperture. Line-segment G measures 12¼" from the front edge 10 of the top panel to the top edge 15 for the back of the panel.

Line-segment E is the uppermost portion of the panel and includes a slight curve 17 that begins just before the top of the rear aperture 15, which helps to angle the closing strap 25° relative to the apex of the crown, see line-segment K defining the 25° angle. Line-segment F includes half of the oval aperture and measures from about 3" to about 6" in length.

Near the apex, line-segment H measures 3½" from the upper most portion of the top panel to the bottom of the panel. Line-segment I measures 12" in length from the upper most portion of the panel to the bottom of the closing strap. Line-segment J measures 16" from the front edge 10 of the panel to the bottom of the closing strap. Grid markers m and n show the panel as a front portion and a back portion, where the front portion is the top panel used to cover the top of the crown and the back portion includes the closing straps and aperture. The bespoke cap, FIG. 1*c*, is formed when all fabric pieces are sewn together at their natural points to the uncovered crown.

Remaining Feature of the Bespoke Cap

Figure 9B:
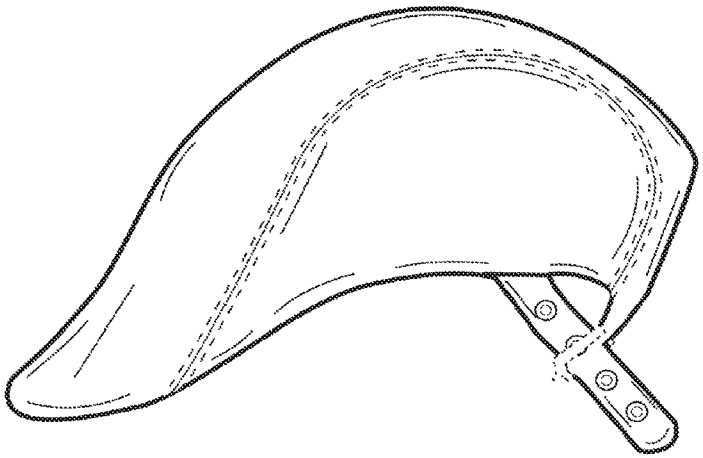
FIG. 9*b* shows a left facing side view of the bespoke cap.
Figure 9A:
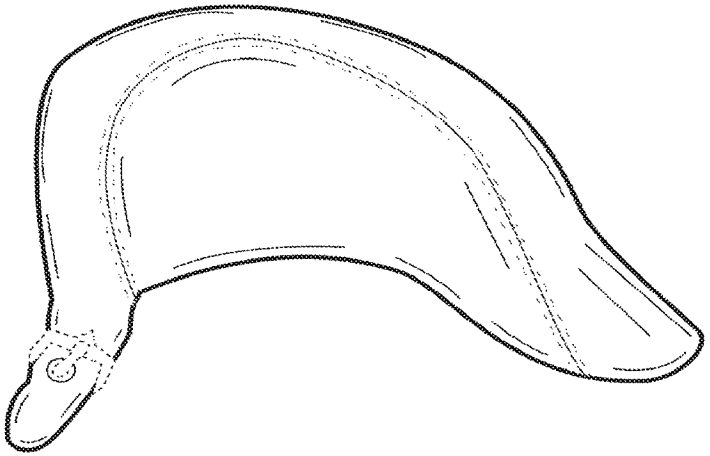
FIG. 9*a* shows a right facing side view of the bespoke cap.

FIG. 9*a* and FIG. 9*b* show side views of the bespoke cap. Each view shows that the closing straps associated with each top panel has a closure system that includes a buckle attached to the left strap through means known within the arts and grommets pressed into holes to accommodate the prong of the buckle when adjusting the size of the aperture when gathering locks.

Figure 10:
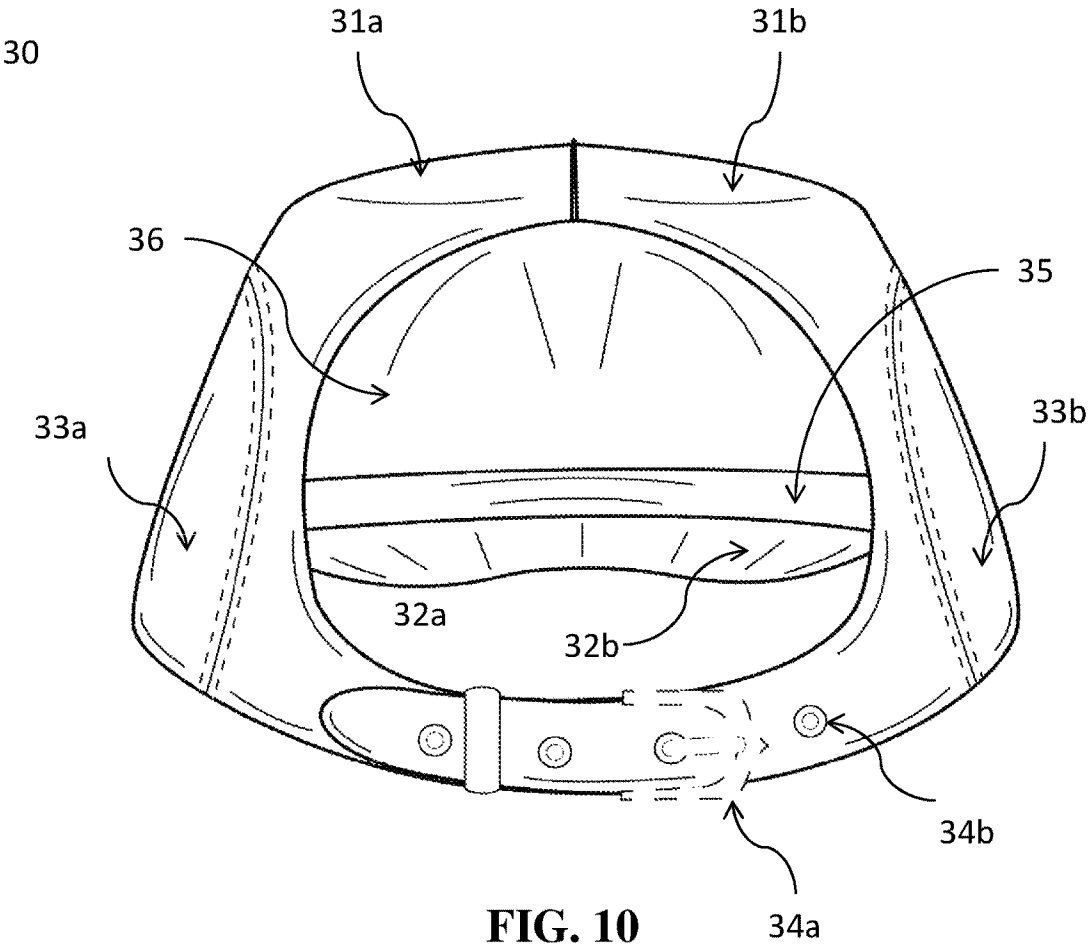
FIG. 10 shows a rear view of the bespoke cap, adjustable aperture, and straps with a buckle and grommets. The inner portion of the bespoke cap shows the inner cap band and illustrates how the top panels are stretched, folded over, and sewn to the underside of the brim.

FIG. 10 shows a rear view of the bespoke cap 30. The outside portion of the first layer, the crown, is covered by the five piece fabric pattern having top panels 31*a* and 31*b*, side parts 33*a* and 33*b*, a front facing brim 32*a*, and closing straps with a buckle 34*a* and grommets to accept the prong of the buckle 34*b*. The cap band 35 is attached about the inner periphery of the lower edge of the crown. Each top panel 31*a* and 31*b* is depicted as being stretched, folded over, and sewn to the underside of the brim, as depicted by the lines indicated by 32*b*, which gives the final construct a flat-cap appearance. The adjustable aperture measures about 6" from the top center of the aperture to bottom portions of the closing straps 34*a* and 34*b*. The long [horizontal] axis of the oval aperture measures from about 3½" to about 8".

Figure 11:
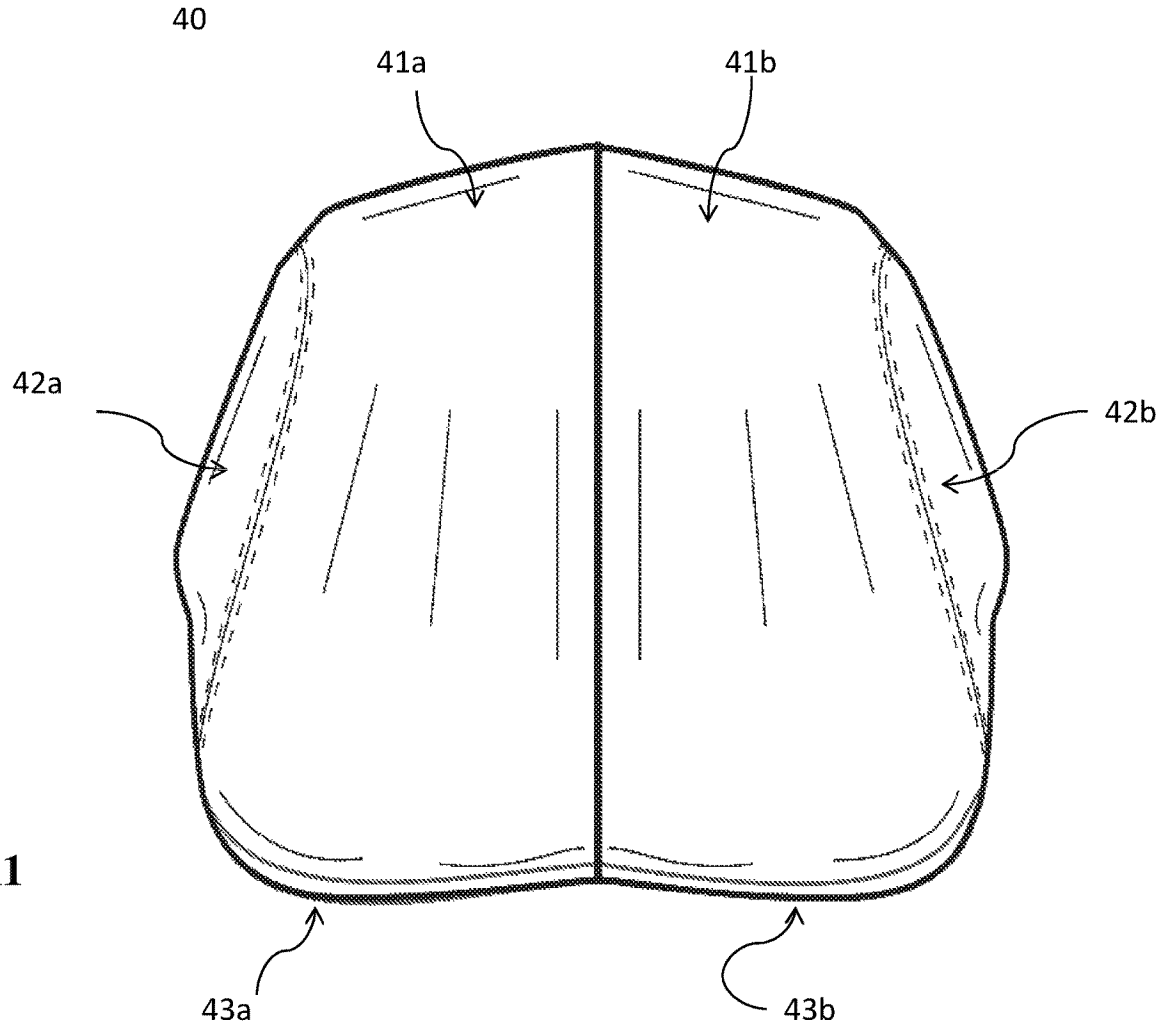
FIG. 11 depicts the front view of the bespoke cap showing how the top panels stretch and fold over to the underside of the brim.

FIG. 11 depicts the front view of the bespoke cap 40. This view shows how the top panels 41*a* and 41*b* stretch and fold over to the underside of the brim, depicted by designations 43*a* and 43*b*. The side parts 42*a* and 42*b* are also shown.

Figure 12:
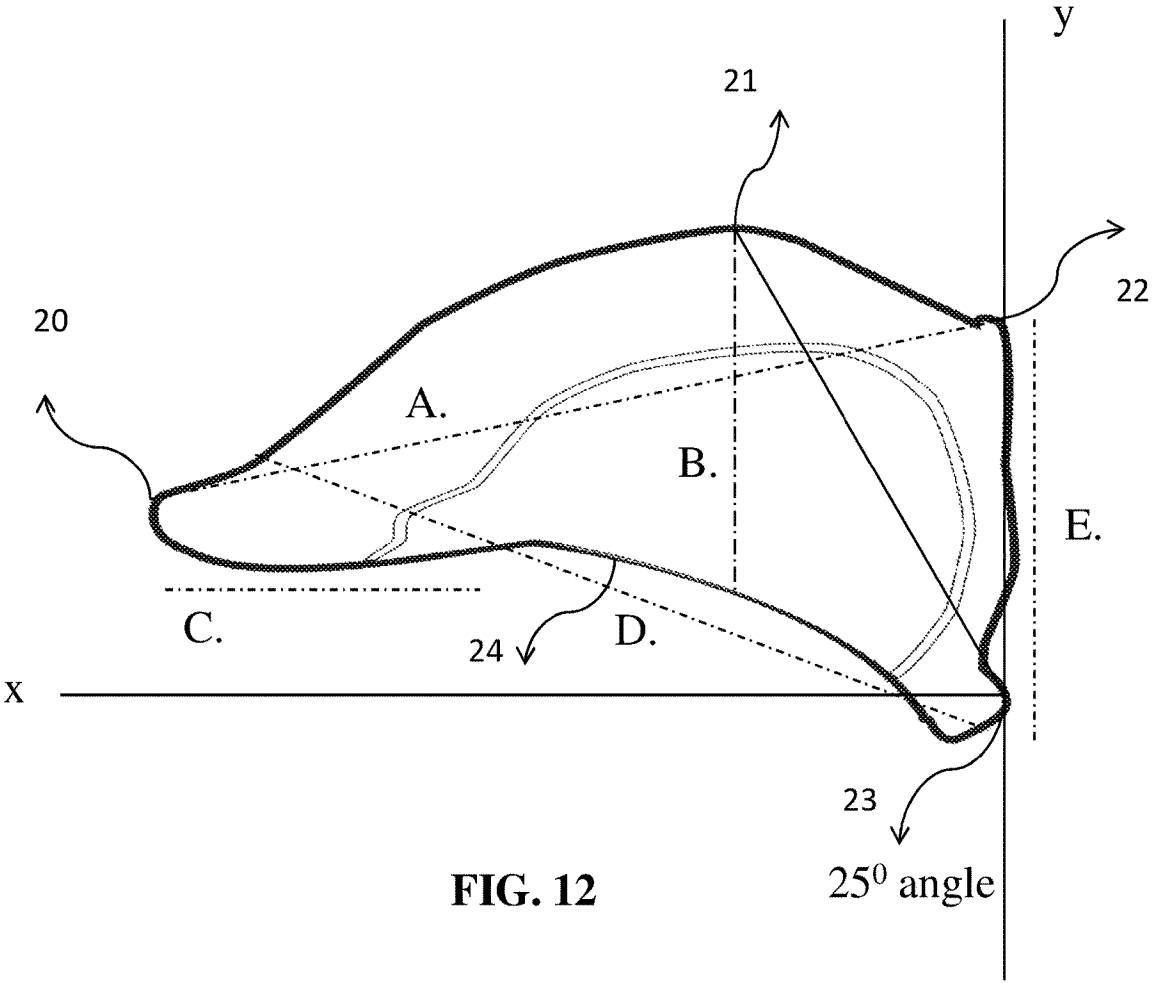
FIG. 12 shows a side view of the bespoke cap with dimensions in a simplified x-y plane.

FIG. 12 shows the side view of the bespoke cap with line-segments in a simplified x-y plane. Line-segment A measures 12¼" from the brim tip 20 to the top of the rear aperture 22. Line-segment B measures 6⅜" from the apex of the crown 21 to the lower peripheral edge 24 that extends circumferentially around the crown. Line-segment C measures 6" from the center tip of the brim 20 to the connection point of the brim at the lower peripheral edge 24 that extends circumferentially around the crown. Line-segment D measures 10⅜" inches from the tip of the brim 20 to the center of the nape of the neck 22, where the adjustable straps are positioned. The straps rest at a 25° angle 23 relative to the apex of the crown 21. Line-segment E measures 6" from the top of the rear aperture 22 to the center of the nape of the neck 23, where the adjustable straps are positioned.

The foregoing words describe one embodiment for making a bespoke cap for dreadlocks. However, these words are not a limitation on the scope of the present invention, but are written to detail certain embodiments thereof. It should be understood that changes may be made by one of ordinary skill in the art to the invention without departing from the scope of the invention. Thus, the scope of the present invention is defined solely by the following claims.

I claim:

1. A bespoke cap comprising:

a.) a first layer comprising a plurality of stitched gore sections forming a crown with a front portion and a back portion, a crescent shaped brim attached to the gore sections along the front portion of the crown, and a rear half oval aperture formed in the gore sections at the back portion of the crown;

b.) a second layer comprising a left piece, a right piece, two top panels each having a rear curvature and a crescent shaped brim cover, wherein the two top panels are attached together along a first side edge, are attached to the left piece or the right piece along an opposite second side edge, are attached to the crescent shape brim cover at a first end and comprise a closing strap at a second end; and c.) wherein the left piece, the right piece and the two top panels are stitched to and on top of the gore sections of the first layer, the crescent shaped brim cover is stitched to and on top of the crescent shaped brim of the first layer, wherein the rear curvature of the two top panels of second layer are stitched to and in alignment with the rear half oval aperture formed in the gore sections of the first layer, thereby forming a bespoke cap with an adjustable rear half oval opening.

2. The bespoke cap of claim 1, wherein each gore section of the plurality of gore sections has a reuleaux-triangle shape and is made from a material consisting of singly ply buckram, buckram mesh, double buckram mesh, satin, cotton, wool, rayon/cotton blend, polyester or any combinations thereof.

3. The bespoke cap of claim 1, wherein the rear closing strap of the two top panels comprises an adjustable closure selected from the group consisting of clasps, buckles and grommets, snaps, hooks and loops, or any combinations thereof.

4. The bespoke cap of claim 1, wherein a cap band is attached to and extends circumferentially around an inside lower peripheral edge of the crown.

5. The bespoke cap of claim 4, wherein the cap band is made from a material selected from the group consisting of leather, satin, cotton, wool, rayon/cotton blend, polyester, or any combination thereof.

6. The bespoke cap of claim 1, wherein the stitched gore sections comprise a layer of buckram mesh and another layer of a material selected from the group consisting of silk, satin, cotton, wool, rayon/cotton blend, polyester, or any combinations thereof.

7. The bespoke cap of claim 1, wherein a first end of each top panel is folded over and stitched to an underside of the crescent shaped brim.

* * * * *